US007879116B2

(12) United States Patent
Hazarika et al.

(10) Patent No.: US 7,879,116 B2
(45) Date of Patent: Feb. 1, 2011

(54) FUEL ADDITIVE

(75) Inventors: Ronen Hazarika, Poole (GB); Bryan Lawrence Morgan, Poole (GB)

(73) Assignee: Neuftec Limited, Roseau (DM)

( * ) Notice: Subject to any disclaimer, the term of this patent is extended or adjusted under 35 U.S.C. 154(b) by 989 days.

(21) Appl. No.: 11/627,741

(22) Filed: Jan. 26, 2007

(65) Prior Publication Data

US 2008/0028673 A1 Feb. 7, 2008

Related U.S. Application Data

(63) Continuation of application No. 10/312,263, filed as application No. PCT/GB01/02911 on Jun. 29, 2001, now Pat. No. 7,195,653.

(30) Foreign Application Priority Data

Jun. 29, 2000 (GB) ..... 0016032.5
Sep. 13, 2000 (GB) ..... 0022449.3

(51) Int. Cl.
*C10L 1/18* (2006.01)

(52) U.S. Cl. ..... 44/354; 44/385; 44/457

(58) Field of Classification Search ..... 44/354, 44/457, 385
See application file for complete search history.

(56) References Cited

U.S. PATENT DOCUMENTS

| | | | | |
|---|---|---|---|---|
| 2,402,854 | A | 6/1946 | Thomas | |
| 2,913,319 | A * | 11/1959 | Trautman | 44/354 |
| 3,845,177 | A * | 10/1974 | Burnett | 264/0.5 |
| 4,264,335 | A | 4/1981 | Bello et al. | |
| 4,568,360 | A | 2/1986 | Brisset et al. | |
| 5,137,730 | A | 8/1992 | Dennis et al. | |
| 5,240,896 | A | 8/1993 | Nam et al. | |
| 5,460,701 | A | 10/1995 | Parker et al. | |
| 5,514,349 | A | 5/1996 | Parker et al. | |
| 5,840,769 | A | 11/1998 | Kolter et al. | |
| 5,874,684 | A | 2/1999 | Parker et al. | |
| 5,993,967 | A | 11/1999 | Brotzman, Jr. et al. | |
| 6,033,781 | A | 3/2000 | Brotzman, Jr. et al. | |
| 6,093,223 | A | 7/2000 | Lemaire et al. | 44/354 |
| 6,096,104 | A | 8/2000 | Van den Neste et al. | |
| 6,096,698 | A | 8/2000 | Milling | |
| 6,203,768 | B1 | 3/2001 | McCormick et al. | |
| 6,210,451 | B1 | 4/2001 | Chopin et al. | 44/357 |

FOREIGN PATENT DOCUMENTS

| | | | |
|---|---|---|---|
| AT | 97016886 | A | 9/1998 |
| DE | 19701961 | | 12/1998 |
| EP | 0 794 004 | A1 | 10/1932 |
| EP | 0485551 | | 5/1992 |
| EP | 0 575 189 | A | 12/1993 |
| EP | 0 599 717 | A1 | 6/1994 |
| EP | 0 671 205 | A2 | 9/1995 |
| FR | 734135 | | 10/1932 |
| FR | 2172797 | | 10/1973 |
| GB | 1 005 957 | | 9/1965 |
| JP | 500243 | | 1/1993 |
| SU | 1761701 | A1 | 9/1992 |
| WO | WO 98/04655 | | 2/1998 |
| WO | WO 99/13026 | | 3/1999 |
| WO | WO 00/49098 | | 8/2000 |

* cited by examiner

*Primary Examiner*—Cephia D Toomer
(74) *Attorney, Agent, or Firm*—McDermott Will & Emery LLP

(57) ABSTRACT

This invention relates to a method for improving the efficiency with which fuel is burnt in a fuel burning apparatus, particularly an internal combustion engine, comprising dispersing an amount of at least one particulate lanthanide oxide, particularly cerium oxide, in the fuel. This invention further relates to tablets, capsules, compositions and liquid fuel additives suitable for dispersing a lanthanide oxide in fuel.

11 Claims, No Drawings

FUEL ADDITIVE

This application is a continuation of U.S. Ser. No. 10/312,263, filed Feb. 5, 2003, now U.S. Pat. No. 7,195,653, which is a National Phase of International Application No. PCT/GB01/02911, filed Jun. 29, 2001, which claims priority from British Application No. 0016032.5, filed Jun. 29, 2000, and British Application No. 0022449.3, filed on Sep. 13, 2000 all of which are herein incorporated by reference.

This invention relates to a method for improving the efficiency of combustion processes and/or reducing harmful emissions. This invention further relates to a composition, tablet, capsule or liquid fuel additive suitable for dispersing a lanthanide (rare earth) oxide in a fuel.

Lanthanide compounds, particularly organometallic compounds of cerium, are known to be useful additives in fuel because they aid combustion. It is believed that these compounds adsorb onto the asphaltenes always present in fuel oil. During the combustion process, metal oxides are formed and, because of the catalytic effect of rare earth oxides on the combustion of asphaltenes, they reduce the quantity of solid unburned components released during combustion. Hence, organometallic lanthanide additives in fuel have an effect on improving combustion and reducing harmful emissions.

Several documents in the prior art describe the use of lanthanide compounds as fuel additives. For example, French patent 2,172,797 describes organic acid salts prepared from rare earths, particularly from cerium, which are useful as combustion aids. The use of organic acid salts of rare earth compounds was necessary since these compounds were found to be soluble in fuels.

U.S. Pat. No. 4,264,335 describes the use of cerium 2-ethylhexanoate for suppressing the octane requirement of a gasoline-fired internal combustion engine. Cerium 2-ethylhexanoate was found to be more soluble in gasoline than cerium octanoate.

U.S. Pat. No. 5,240,896 describes the use of a ceramic material containing a rare earth oxide. The ceramic material is insoluble in fuel. It is alleged that combustion of the liquid fuel is accelerated upon contact with the solid ceramic.

European patent 0485551 describes a device which conveys dry particles of a rare earth oxide directly to the combustion chamber of an internal combustion engine via the air intake.

In general, the fuel additives described in the prior art employ organic acid salts of rare earth elements, which are soluble in fuel. It is believed that these compounds are converted to rare earth oxides in the combustion chamber. Thus, the rare earth oxides are the active catalytic compounds.

Organic acid salts of lanthanides such as cerium are generally highly viscous liquids or low melting point solids. These compounds are inherently difficult to introduce into fuel in a convenient manner. Furthermore, such materials are expensive to manufacture and difficult to handle.

Although lanthanide oxides can be bought in large quantities at a relatively low cost, these compounds are not considered to be suitable for use in fuels for internal combustion engines. In general, it is desirable to avoid having particulate matter dispersed in the fuel system and in the combustion chamber of an internal combustion engine. Particulate materials are known to block fuel filters and also act as abrasive agents which have harmful effects on the pistons and combustion chamber of the engine. Cerium oxide is a particularly well known abrasive agent.

It is an object of the present invention to provide a method for improving the combustion efficiency of, for example, an internal combustion engine, which is less costly and more convenient than methods that are described in the prior art.

Accordingly, the present invention provides a method of improving the efficiency with which fuel is burnt in a fuel burning apparatus and/or a method of reducing the emissions produced by a fuel which is burnt in a fuel burning apparatus, said method comprising dispersing an amount of at least one particulate lanthanide oxide in the fuel.

When the method of the present of invention is employed, the fuel burning apparatus may be, for example, a boiler, furnace, jet engine or internal combustion engine. A fuel which contains a dispersion of the lanthanide oxide as hereinbefore described is delivered to the combustion chamber of an internal combustion engine or fire box or nozzle head of a burner unit. Preferably, the fuel burning apparatus is an internal combustion engine. The internal combustion engine may be of any type including spark ignition engines and compression ignition engines. Similarly, the fuel may be of any type, including petrol/gasoline (both leaded and unleaded), diesel and LPG (liquid petroleum gas) fuel.

When the method of the present invention is used, particularly in an internal combustion engine, the amount of harmful pollutants is reduced. These pollutants include, for example, CO, $CO_2$, hydrocarbons (HCs) and $NO_x$. The reduction in the amount of harmful pollutants may obviate the need for a catalytic converter in some vehicles. Moreover, the reduction in the amount of harmful pollutants may be effected at a significantly lower cost using the method of the present invention as compared to, for example, the use of a catalytic converter, which requires precious metals such as rhodium, platinum and palladium.

Furthermore, the method of the present invention improves combustion efficiency in, for example, an internal combustion engine ("engine"). Accordingly, an engine will benefit from reduced carbon build up in injectors and combustion chambers, an increase in power and torque, a reduction in engine wear, a reduction in fuel consumption and a reduction in the number of partial misfires which occur in most engines. Additional benefits include a decrease in lubrication oil consumption and extended oil life. When present, catalytic converter life is also extended due to the reduction of unburned hydrocarbons entering the catalyst and also a recharging of the catalyst through lanthanide oxide deposits.

It is an important advantage of the method of the present invention that it can be applied to existing vehicles, even vehicles driven by engines which use unleaded fuel. Moreover, vehicles that are unable to use unleaded fuel due to soft valve seats will be able to use unleaded fuel by employing the method of the present invention. Cerium oxide, for example, in the fuel will provide the same protective properties as tetraethyl lead in preventing valve seat recession. In addition, cerium oxide can suppress the octane requirement of an engine, acting as an octane improver.

As used herein, the term "lanthanide" includes any of the rare earth elements; that is any element from atomic number 58 to 71, and also including scandium, yttrium and lanthanum.

Preferably, the lanthanide oxide comprises a lanthanide selected from cerium, lanthanum, neodymium and praseodymium. Preferably, the lanthanide oxide is $CeO_2$.

As used herein, the term "dispersion" means a persistent suspension or emulsion of solid particles in a liquid medium, or a solution of a solid dissolved in a liquid medium. The term "dispersion" does not include a liquid comprising solid particles which initially disperse, but then settle out.

The particulate nature of the lanthanide oxide facilitates its dispersion in fuel. The particles of lanthanide oxide added to the fuel are discrete particles, rather than aggregates. Hence, the term "particle size" as used herein refers to the primary particle size. Preferably, the mean particle size of the lanthanide oxide is in the range of 1 nm to 100 microns. More preferably, the mean particle size is in the range of 1 nm to 5 microns, more preferably 1 nm to 0.5 microns, more preferably 1 nm to 50 nm, and more preferably 1 nm to 10 nm.

The particle size of the lanthanide oxide affects the extent to which the compound is dispersed in fuel. In general, a small mean particle size (less than 5 microns) is preferred since small particles are usually more readily dispersed in fuels than large particles.

The particles of lanthanide oxide may be produced by methods known in the art, such as mechanical grinding. The grinder may impart a high frequency, low amplitude vibration to the lanthanide oxide as it is ground. Other suitable methods known in the art include vapor condensation, combustion synthesis, thermochemical synthesis, sol-gel processing and chemical precipitation. Preferred methods for producing particles of lanthanide oxide are mechanical chemical processing (see U.S. Pat. No. 6,203,768) and plasma vapor synthesis (see U.S. Pat. No. 5,874,684, U.S. Pat. No. 5,514,349 and U.S. Pat. No. 5,460,701).

Preferably, the particles are generally spheroidal.

The particle size of the lanthanide oxide may be measured by any convenient method, such as laser diffraction analysis or ultrasonic spectrometry.

The amount of lanthanide oxide required will depend on the total surface area of the lanthanide oxide particles and also fuel tank capacity. Accordingly, the smaller the particle size, the smaller the amount of lanthanide oxide required, since smaller particles have a higher ratio of surface area to volume and have enhanced catalytic abilities due to their highly stressed surface atoms which are extremely reactive. Preferably, the particles of lanthanide oxide have a surface area of at least about 20 $m^2/g$, more preferably at least about 50 $m^2/g$, and more preferably at least about 80 $m^2/g$. Preferably, the amount of lanthanide oxide added to the fuel is such that its concentration is in range of 0.1 to 400 ppm. More preferably, the concentration of lanthanide oxide is in the range of 0.1 to 100 ppm, more preferably 1 to 50 ppm, and more preferably 1 to 10 ppm.

It has been found that particles of cerium oxide produced by plasma vapor synthesis retain their high surface area at high temperature. By high temperature, it is meant the typical combustion temperature of an internal combustion engine. Generally, surface area tends to decrease at high temperature in most particles. However, it is a further advantage of the present invention that the particles of cerium oxide produced by plasma vapor synthesis or mechanical chemical processing do not lose surface area at high temperature. This allows them to be used at concentrations as low as 1 to 10 ppm.

In one embodiment of the present invention, the lanthanide oxide is coated with a substance which renders the surface of the lanthanide compound lipophilic. The lipophilic coating aids dispersion of lanthanide oxides in fuels and also helps to prevent agglomeration of the particles. In some cases, the lipophilic coating allows complete solubilisation of the lanthanide oxide in fuel. The lipophilic coating also prevents the particles of lanthanide oxide from reacting with the fuel during storage in a fuel tank. Reaction of the lanthanide oxide and the fuel during storage is highly undesirable, since it leaves solid deposits in the fuel.

The particles may be coated by any suitable coating method known in the art. Suitable coating methods are described in U.S. Pat. No. 5,993,967 and U.S. Pat. No. 6,033,781.

The substance used to coat the surface of the lanthanide oxide is preferably a surfactant. The lipophobic part of the surfactant molecule is embedded into the lanthanide oxide particle, leaving the lipophilic part of the surfactant to interact with the fuel.

Preferably, the surfactant has a low HLB (hydrophilic/lipophilic balance). Surfactants having a low HLB are generally more oil soluble than those surfactants having a high HLB. Suitable low HLB surfactants will be readily apparent to the person skilled in the art. Preferably, the HLB of the surfactant is 7 or less, more preferably 4 or less. Examples of low HLB surfactants are alkyl carboxylic acids, anhydrides and esters having at least one $C_{10}$-$C_{30}$ alkyl group, such as dodecenyl succininc anhydride (DDSA), stearic acid, oleic acid, sorbitan tristearate and glycerol monostearate. Other examples of low HLB surfactants are hydroxyalkyl carboxylic acids and esters having at least one $C_{10}$-$C_{30}$ hydroxyalkyl group, such as Lubrizolo® OS11211. More preferably, the substance used to coat the lanthanide oxide is dodecenyl succinic anhydride (DDSA) or oleic acid.

In this embodiment of the present invention, the coated particles of lanthanide oxide dispersed in the fuel break down immediately upon entering the combustion chamber of an internal combustion engine. The lipophilic coating decomposes quickly in the combustion, chamber, so ensuring that the catalytic activity of the lanthanide oxide is not harmed.

In the method of the present invention other materials may be added to the fuel in addition to the lanthanide oxide. These other materials should all disperse in fuel and not interfere with the combustion process or block filters. Suitable materials include alternative combustion aids that are well known in the art. Examples of alternative combustion aids include compounds of manganese, iron, cobalt, nickel, barium, strontium, calcium and lithium. Such combustion aids are described in U.S. Pat. Nos. 6,096,104 and 4,568,360, the contents of which are incorporated herein by reference.

In addition, compounds such as fragrances may also be added to the fuel in the method of the present invention. Examples of suitable fragrances are jasmine oil, vanilla oil and eucalyptus oil.

Preferably, the fuel is one suitable for use in an internal combustion engine. Examples of such fuels include petrol/gasoline, diesel or LPG (liquid petroleum gas) fuel.

In a further aspect of the present invention, there is provided a tablet suitable for dispersion of at least one lanthanide oxide in fuel comprising at least one lanthanide oxide as hereinbefore described and at least one tabletting aid which is dispersible in the fuel. The term "tablet" as used herein has its usual meaning of a solid tablet of a compressed material.

Known methods for tabletting are principally directed to water-soluble pharmaceuticals. Such methods are well known in the art and are exemplified by the use of tabletting aids such as cellulose, lactose, silica, polyvinylpyrrolidone and citric acid. These and other tabletting aids are described in, for example, U.S. Pat. Nos. 5,840,769 and 5,137,730.

However, these known tabletting aids are unsuitable for preparing lanthanide oxide tablets which are dispersible in fuel. The use of binders such as magnesium stearate, methyl cellulose or silica produces tablets which either do not disperse in fuel, or tablets in which the binder(s) settle out after the tablet has dispersed in the fuel. Such tablets are unsuitable for use as fuel additives since the solid deposits block filters or build up on pistons and combustion chambers.

Preferably, the tabletting aid used in the tablet of this aspect of the present invention is a $C_7$-$C_{30}$ alkyl carboxylic acid, a $C_6$-$C_{30}$ aromatic compound or a polymeric tabletting aid. More preferably, the tabletting aid is tetradecarioic acid.

When the tabletting aid is polymeric, polymers or copolymers of styrene, $C_1$-$C_6$ alkyl-substituted styrenes and $C_1$-$C_6$ alkyl methacrylates are preferred. More preferably, the polymeric tabletting aid is poly(t-butylstyrene), poly(isobutyl methacrylate) or poly(n-butyl methacrylate).

As used herein, the term "alkyl" means a branched or unbranched, cyclic or acyclic, saturated or unsaturated (e.g. alkenyl or alkynyl) hydrocarbyl radical.

As used herein, the term "aromatic compound" means an aromatic hydrocarbon compound, such as benzene or naphthalene, optionally substituted with one or more $C_1$-$C_6$ alkyl group(s). An example of a substituted aromatic compound suitable for use as a tabletting aid in the present invention is durene (1,2,4,5-tetramethylbenzene).

Preferably, the amount of lanthanide oxide in the tablet of the present invention is in the range of 1 to 99.99 wt. %, based on the total weight of the tablet. More preferably, the amount of lanthanide oxide is in the range of 30 to 80 wt. % and more preferably 40 to 60 wt. %. More preferably, the amount of lanthanide oxide in the tablet is about 50 wt. %.

Preferably, the amount of tabletting aid in the tablet of the present invention is in the range of 0.01 to 99 wt. %, based on the total weight of the tablet. More preferably, the amount of tabletting aid is in the range of 20 to 70 wt. % and more preferably 40 to 60 wt. %. More preferably, the amount of tabletting aid in the tablet is about 50 wt. %.

The tablet of the present invention may be obtained by application of a direct compression force to a composition comprising a lanthanide oxide as hereinbefore described and a tabletting aid as hereinbefore described. When the tablet is obtained by direct compression, single stroke presses or rotary head presses may be employed. Alternatively, the tablet may be obtained by injection molding or normal die molding. These and other methods of tabletting will be well known to the person skilled in the art. Generally, it is desirable to maximize the amount of lanthanide oxide in the tablet, while still being able to form tablets from the composition.

In an alternative embodiment of the present invention, there is provided a capsule suitable for dispersion of at least one lanthanide oxide in fuel, the tablet comprising an outer case and a substance contained therein, wherein the outer case comprises at least one tabletting aid as hereinbefore described and the substance contained therein comprises at least one lanthanide oxide.

Capsules are well known for the delivery of, for example, pharmaceuticals. Generally, the outer case has two parts which engage to enclose the substance contained therein. The outer case should generally be dispersible to allow the release of the substance contained therein into a liquid medium. Accordingly, in the present invention, the outer case of the capsule is dispersible in fuel, such as fuel for internal combustion engines.

In a further embodiment of the present invention, there is provided a liquid fuel additive suitable for dispersion of at least one lanthanide oxide in fuel, comprising a dispersion of at least one coated lanthanide oxide as hereinbefore described in an organic liquid medium. Preferably, the lanthanide oxide is coated with a lipophilic coating as hereinbefore described, such as DDSA or oleic acid. The liquid fuel additive may be blended into bulk supplies of fuel or provided in the form of a one shot liquid additive to be added, for example, to the fuel tank of a vehicle. The liquid fuel additive may additionally comprise stabilizing surfactants such as the low HLB surfactants described hereinbefore.

Accordingly, the lanthanide oxide may be in the form of a loose powder, tablet, capsule or liquid fuel additive. These may be dispensed into fuels manually (e.g. by addition to the fuel tank at the time of refueling) or with the aid of a suitable mechanical or electrical dosing device that may be utilized to automatically dose an appropriate amount of lanthanide oxide into the fuel.

This invention further relates to an apparatus comprising an internal combustion engine and a fuel system, wherein said fuel system comprises a fuel tank containing fuel, and means for delivering said fuel from said fuel tank to said internal combustion engine, characterized in that said fuel has at least one lanthanide oxide dispersed therein. Preferably, the apparatus is a ship, airplane or motor vehicle, such as a motor car (automobile), lorry or motor cycle.

Specific embodiments of the present invention are now described by way of example only.

EXAMPLE 1

A tablet was prepared from cerium oxide and tetradecanoic acid by direct compression. The amount of cerium oxide in the tablet was 60 wt. %. The amount of tetradecanoic acid in the tablet was 40 wt. %. The particle size of cerium oxide was about 0.3 μm. This particle size gives a surface area of approximately 20 $m^2$ per gram, as measured by a standard nitrogen adsorption method. The cerium oxide was prepared by mechanical grinding.

The tablet was added to the fuel tank of a 1988 Metro 1300 cc car, running on unleaded petrol, to give a concentration of about 30 ppm of cerium oxide in the fuel.

In normal operation of the vehicle, fuel consumption was reduced by about 40%. In addition, the use of the choke was greatly reduced and the overall performance of the vehicle was drastically improved.

EXAMPLE 2

A tablet was prepared according to Example 1. The tablet was added to the fuel tank of a 1990 petrol Ford Transit, running on unleaded fuel, to give a concentration of about 30 ppm of cerium oxide in the fuel. Before addition of the tablet, the engine of the vehicle was known to suffer from pinking.

After 10 miles of normal operation, the pinking had been eradicated. In addition, performance of the vehicle had improved markedly.

EXAMPLE 3

A tablet was prepared according to Example 1. The tablet was added to the fuel tank of a 1987 Mercedes 300E 2.8 L, running on unleaded fuel, to give a concentration of about 30 ppm of cerium oxide in the fuel.

Before addition of the tablet, the following emission levels were measured from the exhaust:

CO—0.15%, Hydrocarbons—211 ppm, $CO_2$—14.37%.

After addition of the tablet, the following emission levels were measured:

CO—0.01%, Hydrocarbons—50 ppm, $CO_2$—13.97%.

EXAMPLE 4

Cerium oxide particles were coated with stearic acid. A tablet was prepared from the coated cerium oxide particles and poly(isobutyl methacrylate) by die moulding. The amount of coated cerium oxide particles in the tablet was 30 wt. %. The amount of poly(isobutyl methacrylate) in the tablet was 70 wt. %. The particle size of cerium oxide was about 0.3 μm. This particle size gives a surface area of approximately 20 $m^2$ per gram, as measured by a standard nitrogen adsorption method. The cerium oxide was prepared by mechanical grinding.

The tablet was added to the fuel tank of a 1986 Ford Sierra 1.8 L giving a concentration of 30 ppm of cerium oxide in the fuel. The vehicle was previously using leaded fuel and was not specially adapted for the use of unleaded fuel.

The vehicle was able to use unleaded fuel without any observable problems after addition of the cerium oxide tablet. Furthermore, the performance and fuel economy of the vehicle were increased. In addition, more torque was available when towing a caravan.

EXAMPLE 5

A tablet was prepared according to Example 4. The tablet was used in a 1997 Ford Scorpio, running on unleaded fuel, at a concentration of 30 ppm of cerium oxide.

The fuel economy of the vehicle was increased by 10-12% and the performance of the vehicle was noticeably improved.

EXAMPLE 6

Cerium oxide coated with DDSA was added to diesel fuel at a concentration of 4 ppm. The mean particle size of cerium oxide prior to coating was 10 nm. This particle size gives a surface area of approximately 80 m.sup.2 per gram, as measured by a standard nitrogen adsorption method. The particles were made by plasma vapor synthesis. The fuel was used on a static diesel engine coupled to a dynamometer and, smoke emission equipment. After adding the dosed fuel, increased torque and power was observed. In addition, smoke opacity was reduced to zero between 1000 and 2000 rpm. At 2000 to 2500 rpm, smoke was reduced by 30%.

EXAMPLE 7

Cerium oxide coated with DDSA was added to the fuel of a 1998 Jaguar S type 3.0 vehicle at a concentration of 4 ppm. The particle size of cerium oxide prior to coating was 5 nm. This particle size gives a surface area of approximately 150 $m^2$ per gram, as measured by a standard nitrogen adsorption method. The particles were made by plasma vapor synthesis. Average fuel economy increased from 27.1 mpg to 30.5 mpg after the coated cerium oxide had been added to the fuel.

The above examples clearly demonstrate that the addition of a lanthanide oxide according to the present invention to the fuel of vehicles improves their performance, reduces pinking and reduces emissions. In addition, no blocking of filters or excessive piston wear was observed.

It will, of course, be understood that the present invention has been described merely by way of example and that modifications of detail can be made within the scope of the invention.

The invention claimed is:

1. At least one particulate lanthanide oxide for dispersion in a fuel for improving fuel efficiency and/or reducing fuel emissions of a fuel burning apparatus, wherein the particulate of lanthanide oxide is coated with an alkyl carboxylic anhydride.

2. The lanthanide oxide according to claim 1, wherein at least one lanthanide oxide comprises a lanthanide selected from the group consisting of: cerium, lanthanum, neodymium and praseodymium.

3. The lanthanide oxide according to claim 1, wherein at least one lanthanide oxide is cerium oxide ($CeO_2$).

4. The lanthanide oxide according to claim 1, wherein at least one lanthanide oxide has a particle size in the range of 1 to 50 nm.

5. The lanthanide oxide according to claim 1, wherein at least one lanthanide oxide is made by plasma vapor synthesis or mechanical chemical processing.

6. The lanthanide oxide according to claim 1, wherein the alkyl carboxylic anhydride has an HLB of 7 or less.

7. The lanthanide oxide according to claim 1, wherein the alkyl carboxylic anhydride is dodecenyl succinic anhydride (DDSA).

8. The lanthanide oxide according to claim 1, wherein the lanthanide oxide which is dispersed in the fuel is in the form of a tablet, a capsule, a powder, or a liquid fuel additive.

9. The lanthanide oxide according to claim 8, wherein the amount of tablet, capsule, powder or liquid fuel additive dispersed in the fuel is such that the concentration of lanthanide oxide in the fuel is in the range of 1 to 50 ppm.

10. The lanthanide oxide according to claim 1, wherein the particulate of lanthanide oxide is substantially spheroidal.

11. A tablet, capsule, powder or liquid fuel additive comprising at least one particulate lanthanide oxide according to claim 1.

* * * * *